US005078424A

United States Patent [19]

Kadish

[11] Patent Number: 5,078,424

[45] Date of Patent: Jan. 7, 1992

[54] TUBULAR WOVEN RIBBON BOOK BINDING

[75] Inventor: Chester Kadish, Trumbull, Conn.

[73] Assignee: K-Flex, Inc., Madison, Wis.

[21] Appl. No.: 592,231

[22] Filed: Oct. 3, 1990

Related U.S. Application Data

[63] Continuation-in-part of Ser. No. 509,016, Apr. 13, 1990.

[51] Int. Cl.[5] ..... B42D 1/00

[52] U.S. Cl. ..... 281/21.1

[58] Field of Search ..... 281/21.1, 15.1, 23, 281/27, 35, 36; 412/4

[56] References Cited

U.S. PATENT DOCUMENTS

| | | | |
|---|---|---|---|
| 193,036 | 7/1877 | Reynolds | 281/34 |
| 402,485 | 4/1889 | Schubert | 281/36 |
| 951,436 | 3/1910 | Duryea | 281/23 |
| 990,262 | 4/1911 | Hedges | 281/34 |
| 998,283 | 7/1911 | Duryea et al. | 281/23 |
| 2,014,305 | 9/1935 | Alger | 281/29 |
| 2,121,505 | 6/1938 | Martling | 281/21 |
| 2,182,801 | 12/1989 | Frazier | 281/21 |
| 3,437,506 | 12/1964 | Falberg | 281/15.1 |
| 4,299,410 | 11/1981 | Jukola | 281/21.1 |
| 4,547,000 | 10/1985 | Sallinen | 281/35 |
| 4,650,216 | 3/1987 | Carlson | 281/34 |
| 4,911,475 | 3/1990 | Lerman | 281/21.1 |

*Primary Examiner*—Timothy V. Eley
*Assistant Examiner*—Willmon Fridie, Jr.
*Attorney, Agent, or Firm*—Lathrop & Clark

[57] ABSTRACT

A paperback book is disclosed which has a book block with a plurality of sheets joined together at their spine edges. The book also has a stiff cover. A flattened woven tubular ribbon preferably of polyester fibers having interwoven warp yarns and filling yarn which provide interstices for reception of adhesive. The ribbon has first and second longitudinal sections, and is fastened by a first adhesive to the inner spine portion of the cover at the first section and fastened by a second adhesive to the back of the book block at the second section. The book so formed has a book block which is fully attached to the spine of the cover yet which is fully free to flex. The high strength of the plastic fibers and the flexibility of the tubular woven ribbon contribute to a sturdy book binding which allows the pages of the opened book to lie flat.

4 Claims, 5 Drawing Sheets

TUBULAR WOVEN RIBBON BOOK BINDING

This application is a continuation-in-part of application Ser. No. 07/509,016, filed Apr. 13, 1990.

FIELD OF THE INVENTION

This invention relates generally to the field of books and book binding and to paperback book bindings and methods for paperback binding in particular.

BACKGROUND OF THE INVENTION

Paperback books are commonly formed by the process of perfect binding wherein the individual sheets or leaves of a book are assembled and held together by a backbone adhesive, usually a hot melt glue, applied to the spine edges of the leaves to form a book block. The same adhesive which joins the sheets into a book block usually attaches the book block to the inner spine of a stiff paper cover. Paperback books may be produced according to this common method with efficiency and low cost; however, because the book block is affixed along the length of its back to the stiff paper cover the sheets of the book are not free to open fully and the pages in a spread will not lie flat. Books to be used as instruction manuals, cookbooks, workbooks, or textbooks should be readable without the need for the reader to place his hands on the book, so that he may carry on other tasks with his hands while reading the book. Furthermore, because of the stiffness of the spine of the book, when the book is opened a deep depression or "V" is formed at the binding. This deep "V" makes it difficult to read the printing at the inner margins of the bound pages.

A book binding is disclosed in U.S. Pat. No. 951,436 to Duryea which employs a tubular binding formed by adhesively overlapping an elongated piece or strip of pliant flexible material disclosed by Duryea as tough paper, muslin, or the like. However, a tube of ordinary flexible material such as paper or muslin may lack the strength and glue adhesion needed to durably bind the book back to the cover in a commercially acceptable manner. The disclosure of U.S. Pat. No. 998,283 to Duryea et al. recognizes this by providing additional strength to the binding of U.S. Pat. No. 951,436 by having lateral extending portions from the sides of the tubular book bindings which are glued between the back cover and the end sheets of a book. The tubular book bindings of the Duryea patents are not in widespread use. To be practical, a tubular binding requires a durable and flexible material exhibiting substantial tensile strength.

An attribute of most previous materials employed for tubular bindings is a tendency for the glue which is used to attach the tubular binding to the back of the -hook block and to the spine of the book cover to render the tubular material inflexible and brittle such that when the bound book is opened the glue in the area along the hinges between the cover and the book block cracks and breaks the material of the tube.

U.S. Pat. No. 4,547,000 to Sallinen teaches a method of overcoming the glue saturated enbrittlement of the tubular binding by wrapping the tubular binding around the side of the book back and leaving the portions so wrapped free of glue to form flexible hinges. Leaving these hinge areas unglued, however, involves additional cost and complexity in manufacturing. Sallinen discloses a tubular binding using some elastically flexible material such as plastic or crepe nonpenetrable by glue. The commercial embodiment of the Sallinen invention utilizes paper or paper reinforced with gauze mesh, both materials which must be kept glue free to remain flexible.

Another method for producing paperback bindings which allows the bound pages to lie flat is known which attaches the book block to a flexible crepe capping which provides support for the sheets of the book block but which is not directly attached to the spine of the cover, rather the book block is attached to the cover by stripes of glue affixing the first and last sheets of the book block to the stiff paper cover on either side of the cover's spine. Thus the entire weight of the book block is carried on only a small portion of a ribbon and two sheets of paper. Furthermore, this method requires that a portion of the first and last pages of the book block be given over to adhesive purposes.

What is needed is a paperback binding which would leave the book block free to bend—allowing the book to lie flat when opened—yet which is also sturdy and simple to manufacture.

SUMMARY OF THE INVENTION

The paperback book of this invention has a book block with a plurality of sheets joined together at their spine edges. The book also has a stiff cover. A flattened tubular woven ribbon, preferably of yarn formed from polyester filaments, has interwoven warp yarns and filling yarn which present interstices for reception of glue, the ribbon has first and second longitudinal sections. The ribbon is fastened by a first adhesive to the inner spine portion of the cover at the first section and fastened by a second adhesive to the back of the book block at the second section. The book so formed has a book block which is fully attached to the spine of the cover yet which is fully free to flex.

It is an object of the present invention to provide a tublar binding for a book which has superior strength in affixing the book block back to the spine of the cover.

It is an additional object of the present invention to provide a paperback book binding which provides flexibility to the spine of the book block while maintaining the stiffness of the spine of the cover.

It is also an object of the present invention to provide a method of making a plurality of paperback books in an efficient and cost effective manner by the use of a woven tubular ribbon binding which may be applied in a continuous manner to join a plurality of book blocks to the spines of the book covers.

It is a further object of the present invention to provide a woven tubular ribbon binding which may be completely covered with glue around its outside diameter and yet will form a strong flexible hinge adjoining the book block to the cover without requiring the hinge to be glue free.

Further objects, features and advantages of the invention will be apparent from the following detailed description taken in conjunction with the accompanying drawings showing a preferred embodiment.

DESCRIPTION OF THE PREFERRED EMBODIMENT

Figure 1:
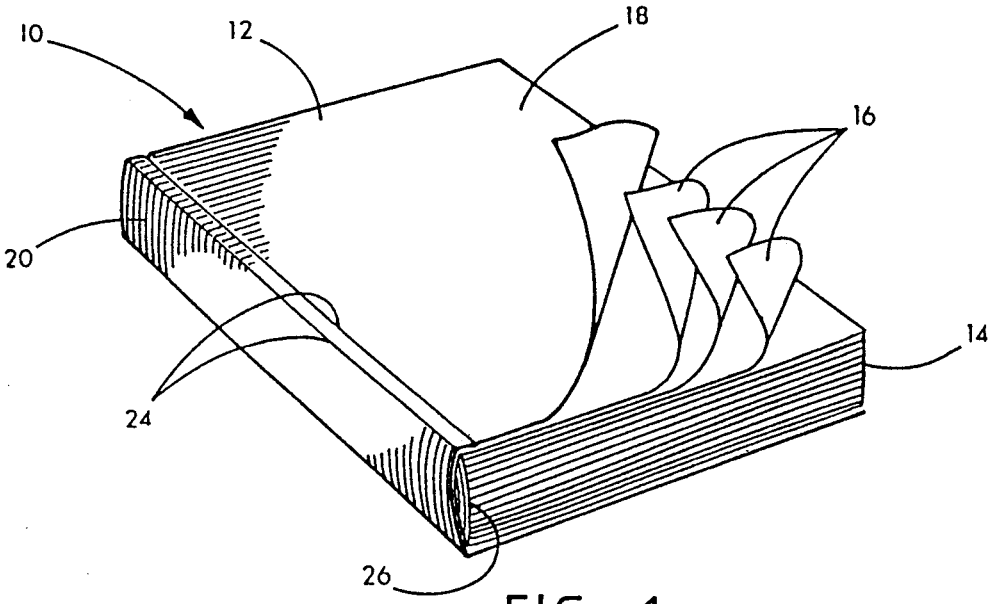
FIG. 1 is an isometric view of the closed paperback book of this invention.

Referring more particularly to FIGS. 1–8 wherein like numbers refer to similar parts, the paperback book 10 of FIG. 1 has a cover 12 affixed to a book block 14. The book block is formed by assembling the individual sheets 16 of the book and affixing the spine edges of the sheets 16 together by applying an adhesive. The book block 14 may be prepared in a conventional manner on a typical binding line. The necessary sections, signatures, or sheets are collated to form the book block 14. The blocks are inserted into moving clamps which pass over saws, mills, knives, and brushes as needed to prepare the spine for gluing. For a more flexible backbone, several types of glue may be applied to the book block. First an aqueous primer glue such as Swift's 24988 may be applied to the back 32 (see FIG. 4) of the book block with rollers or an extrusion applicator. The book block may then be carried over a heated chamber to allow the glue to penetrate the back and to remove moisture. Then, a flexible hot melt glue such as Swift's 84123 may be applied with rollers to the back of the book block over the previous applied primer.

A less flexible book block 14 can be obtained by skipping the aqueous primer glue application and instead applying an adhesive such as Swift's glue nos. 85062 or 84123. Using a single adhesive permits use of a shorter binding line.

The cover is a folded sheet of stiff paper stock having a front cover 18, a spine 20 and a back cover 22. Crease or scoring lines 24 may be provided on the front and back covers 18, 22 to facilitate opening of the covers. This scoring may be the normal scoring conventionally used in perfect binding.

Figure 4:
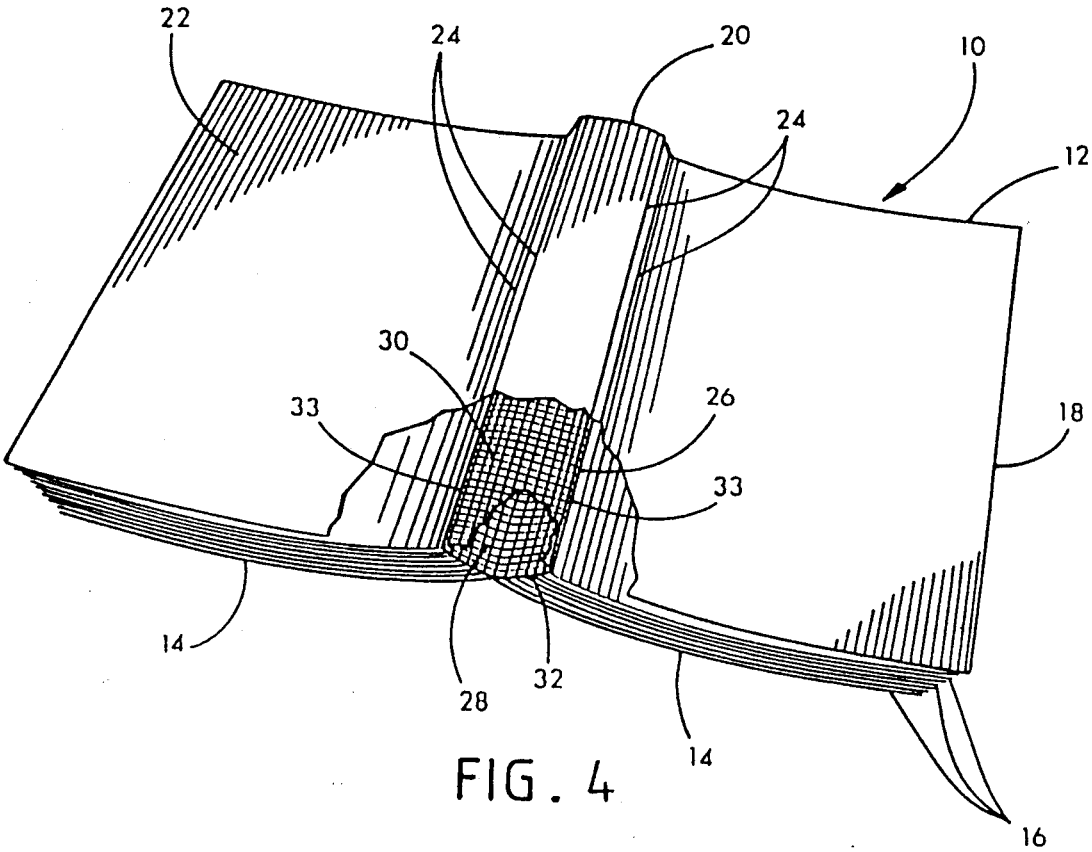
FIG. 4 is a partial cut-away view of the spine of the paperback book of FIG. 2, with a portion of the tubular ribbon cut away.
Figure 5:
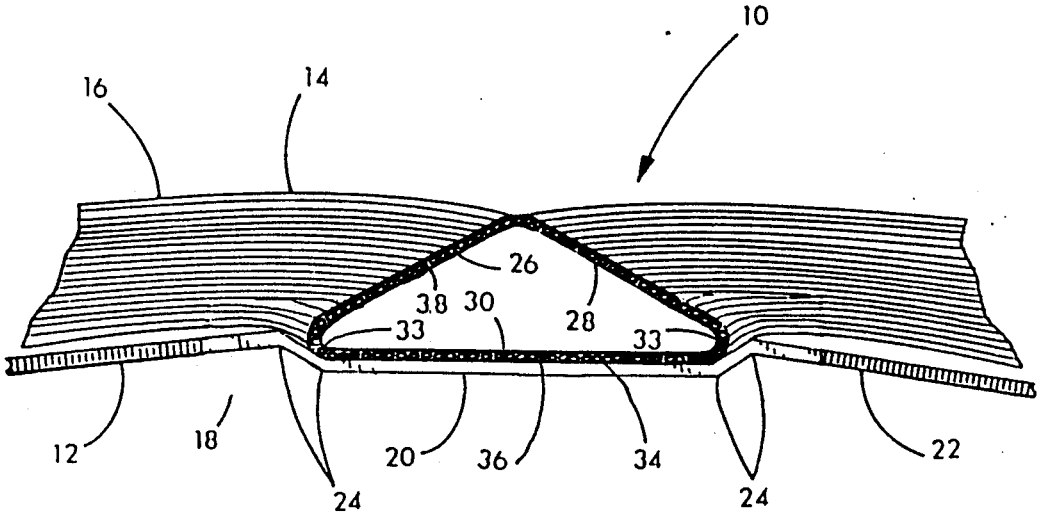
FIG. 5 is an enlarged fragmentary end view of the opened book of FIG. 2.

The cover 12 is affixed to the book block 14 by means of a tubular woven ribbon 26 as best seen in FIGS. 4 and 5. Tubular ribbons, although conventional in the textile industry for many uses, to the best knowledge of the inventor have not been employed for book binding. A tubular woven ribbon, as defined herein, is a ribbon tube which is woven as a continuous tube. In a tubular ribbon, no adhesive is required to form the woven material into a tube. The ribbon is a flexible continuous tube of woven yarns which when brought in contact with the cover 12 and book block 14 is flattened to define a first longitudinal section 28 and a second longitudinal section 30. The tubular woven ribbon 26, when flattened, is preferably at least as wide as the book block 14 is thick and is substantially as long as the book block is tall. The ribbon 26 may be of a synthetic material such as nylon, polyurethene, or other plastic, but is preferably a woven polyester material. The ribbon 26 is a woven material which is supplied as a flat tube and is of sufficient tensile strength to retain the cover on the book block during normal expected conditions of use. A preferred ribbon is as wide as the book block 14 is thick.

Figure 6:
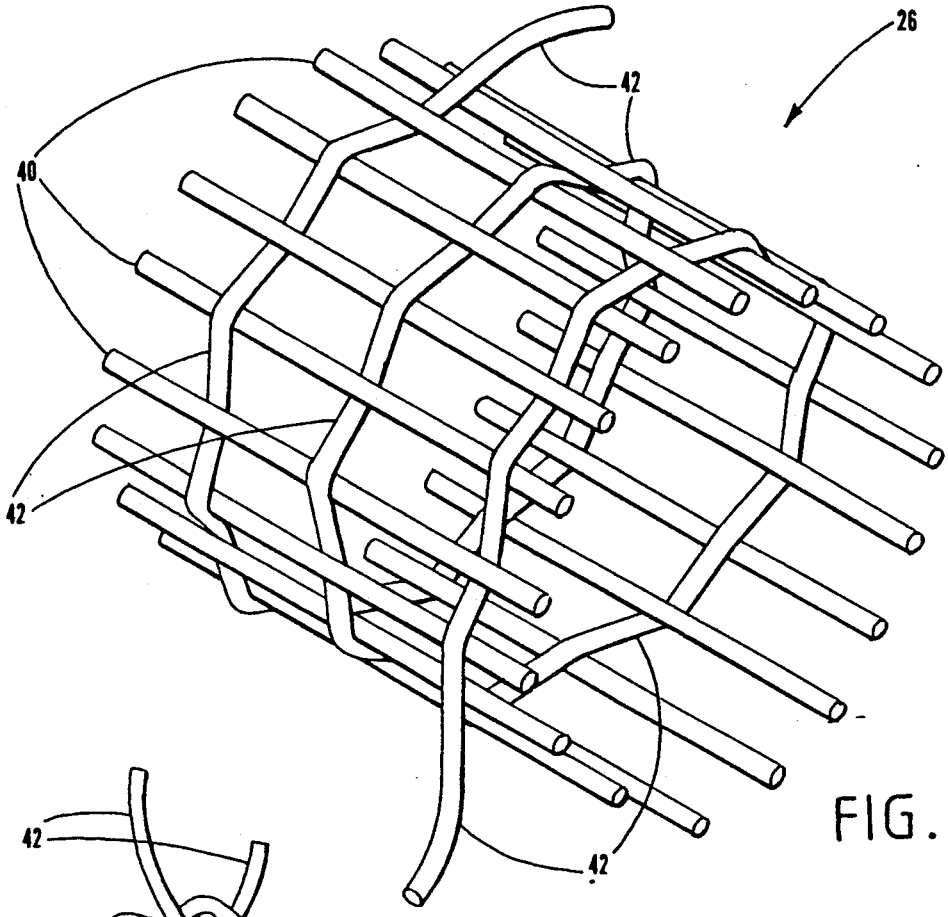
FIG. 6 is an isometric schematic view representative of the weave of the tubular woven ribbon of the binding of this invention.
Figure 7:
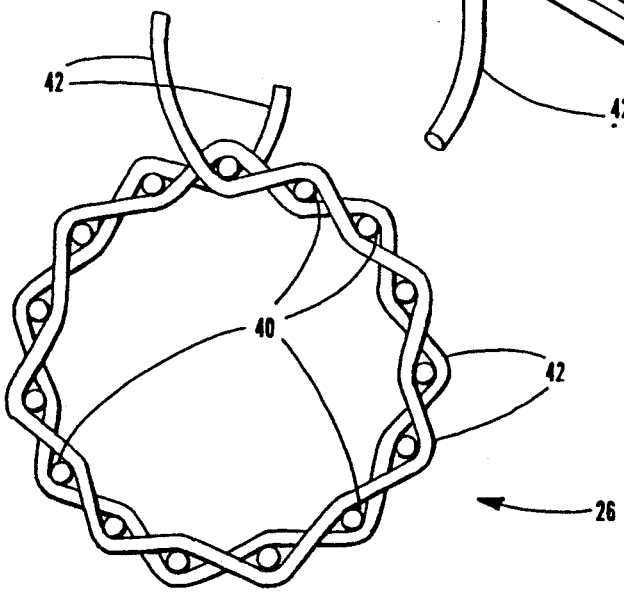
FIG. 7 is a schematic side elevational view of the tubular woven ribbon of FIG. 6.

A schematic representation of the weave of the ribbon 26 is shown in FIG. 6. The spacing, number, and size of the yarns are not proportional to those of an actual ribbon. In the illustrative schematic view of FIG. 7, the ribbon end is shown as a cylindrical tube to indicate the symetrical nature of the weave, although the ribbon is woven and employed in the binding as a flattened tube. An exemplary tubular ribbon of ⅝ inch width has a plain weave tubular woven structure made of approximately 128 warp ends 40 of 70 Denier, 34 filament, bright polyester; having filling yarn 42 which is 70 Denier, 34 filament textured polyester yarn woven at 50 picks per inch on each side of the tube. An exemplary ¾ inch wide ribbon is a plain weave tubular woven ribbon, which has 160 warp ends of 70 Denier flat polyester, with filling yarn which is 90 picks per inch (on both sides of the ribbon) of 70 Denier false twist textured polyester yarn. The filling yarn 42 spirals about the warp ends 40, yielding a continuous tubular woven ribbon which may be produced to any desired length to accommodate any size book or book production line. The filling yarn successively weaves over and under adjacent warp yarns as it spirals around the tubular ribbon, in a plain weave fashion, so that each warp yarn is successively engaged on opposite sides by each pass of the filling yarn. The ribbon material, when used with a hot melt adhesive, must be able to withstand temperatures of 300°–350° F. Preferably, the ribbon is heat treated to dimensionally stabilize the ribbon as well as to make the ribbon more resistant to penetration by adhesive. The bright polyester of the warp has a high tensile strength which yields a ribbon which is particularly strong and capable of carrying the loads required by a book binding.

The tubular woven ribbon of the binding may be fabricated across a range of warp yarns and pick counts. A denser weave may be appropriate when a higher temperature, less viscous, adhesive is used; a more open weave may be appropriate when a more viscous, lower temperature adhesive is employed. For polyester yarns of the composition described in the above examples, the range of effective weaves would be from 100 to 200 warp ends in a ¾ inch ribbon with 25 to 80 picks per inch on each side of the ribbon. In warp ends per inch width of ribbon, the acceptable range for yarns of this material is approximately 133 to 266. For a ¾ inch ribbon the preferred ribbon characteristics are 160 warp ends with 50 picks per side. The number of warp ends for ribbons of different widths would be propertional to the ranges for a ¾" ribbon.

The important consideration in choosing the weaving specification of a particular ribbon is that the surfaces of the ribbon should have yarn spacing which is wide enough to provide good glue adhesion for the particular adhesive to be employed, yet not be such an open weave that there will be strike through of the adhesive onto the opposed interior surface of the ribbon resulting in the ribbon being glued to itself.

The ribbon is preferably made of fibers of polyester, which have both high tensile strength, high flexure strength and flexure modulus. This high strength in tension and in flexure allows the woven tubular binding of this invention to form a resilient durable hinge between the book back and the cover even when the outside diameter of the tubular binding has been completely coated with glue. Polyester also has a high heat deflection temperature which is required to be compatible with certain hot melt glues.

Yarns of other synthetic fibers such as nylon, polypropelene, acetate and others may be employed, depending on economic factors and the strength required for a particular binding application.

Likewise, in certain applications it may be appropriate to utilize tubular woven ribbons of natural fibers.

Thus the tubular woven polyester ribbon achieves sufficient strength to form a flexible hinge after the glue has flexed or creased when the book is opened. Even though covered with glue, the woven ribbon retains its flexibility. There is no need to leave a glue-free zone for purposes of forming a hinge. The tubular woven ribbon binding of this invention is also advantageous in the continuous production of books on an assembly line. As the ribbon is supplied to the spine of the cover as a preformed tube, no step is required in binding to create the tube. Furthermore, a plastic tubular ribbon may be effectively cut with a hot knife which does not require an opposing member, providing for efficient separation of the continuous ribbon into portions on each cover.

In the paperback book of this invention, the outer surface of the second section 30 of the woven ribbon 26, which is continuous with the first section 28 along its longitudinal edges 33, is attached to the inside spine 34 of the cover 12 by an adhesive 36. The outer surface of the ribbon 26 at the first section 28 is adhesively attached to the back 32 of the book block 14 by an adhesive 38. The adhesives 36 and 38 are preferably a hot melt adhesive such as Swift's 85062, alternatively, aqueous adhesives, animal adhesives, or other appropriate adhesives may be used. One or more layers of adhesive may be employed. The adhesives used should not penetrate the ribbon so that the two sections 28 and 30 are not attached to one another. The woven polyester ribbon of this invention is preferably heat treated to render it resistant to the penetration of adhesive. The same adhesive which is used to join the sheets 16 in the book block 14 may also serve to attach the book block 14 to the ribbon 26 or a second layer of adhesive may be used.

Figure 8:
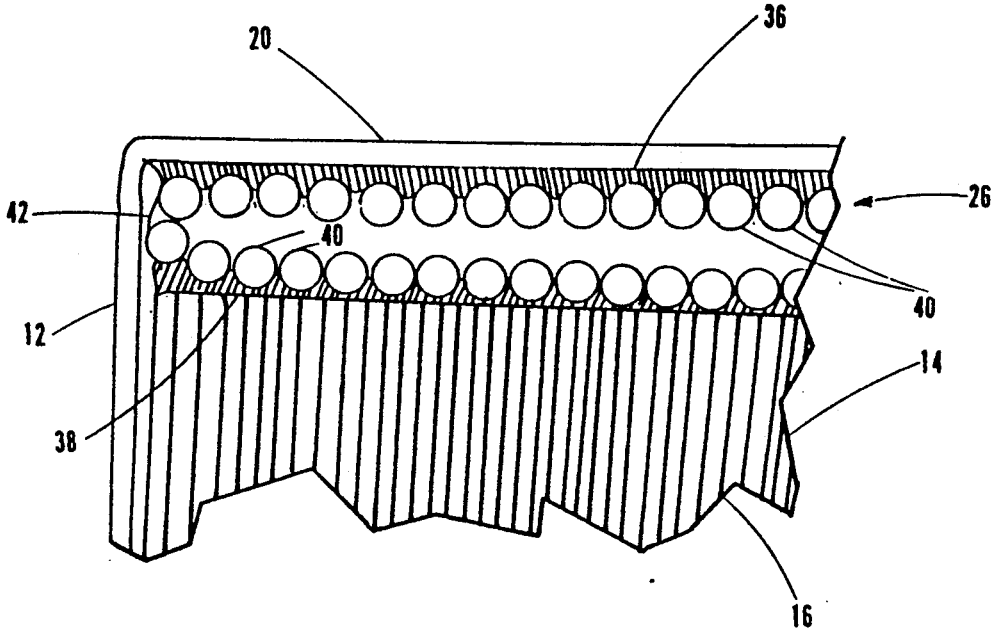
FIG. 8 is a schematic side view of a portion of the adhesively attached tubular woven ribbon of the book of FIG. 1.

FIG. 8 is a schematic view of the tubular woven ribbon 26 adhesively attached to the book block back 32 and the cover spine 34. The adhesive 36 adheres to the cover spine 34 and to the surface of the ribbon first section 28 with the adhesive extending along the surfaces of the warp ends 40 and the filling yarns 42. The interwoven warp yarns and filling yarn present interstices for reception of glue to increase the area of bonding between the glue and the peripheral surfaces of the yarns. These surfaces provide areas for adhesion that would not be found in a ribbon formed from paper or extruded plastic sheets.

Figure 2:
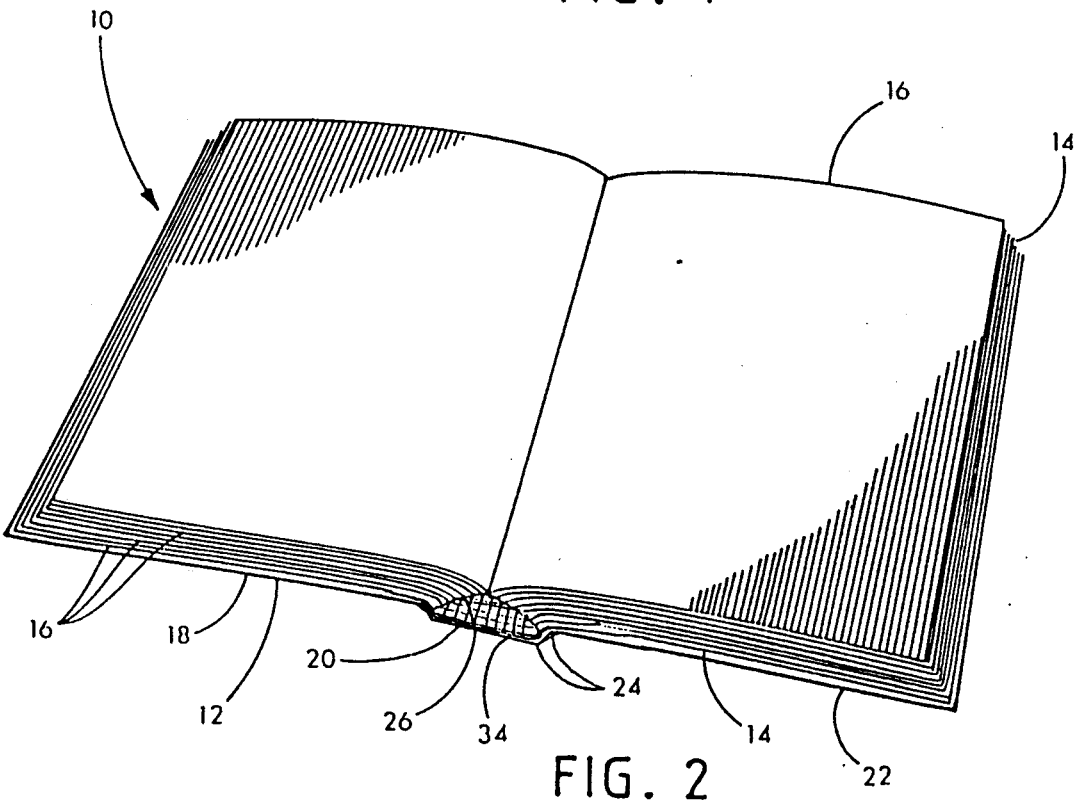
FIG. 2 is a perspective view of the book of FIG. 1 in an opened position.
Figure 3:
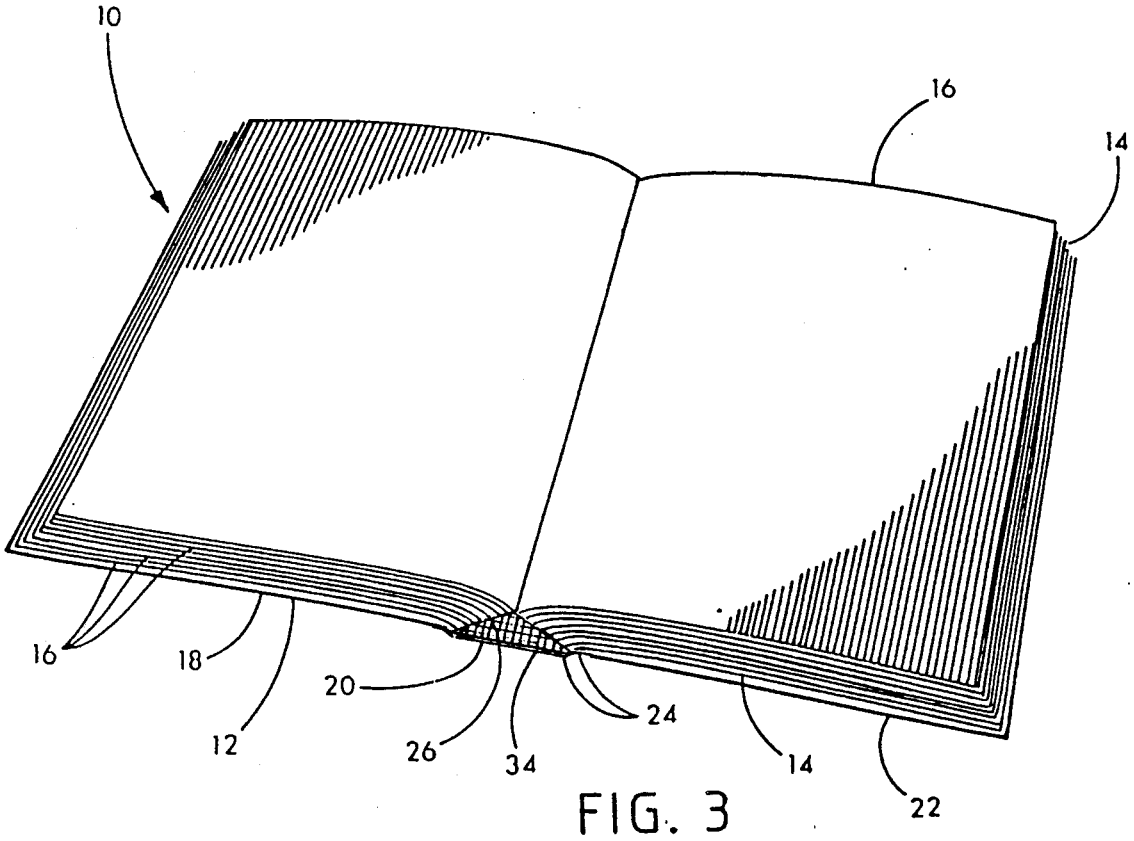
FIG. 3 is a perspective view of the opened book of FIG. 2 with the pages pushed down to lie flat.

No adhesive is applied to the inner surfaces of the tubular ribbon 26, thus the two sections 28, 30 of the ribbon 26 while attached along their edges are free to Pull away from each other and move independently within the constraints of their edge connections. As the book block 14 is nowhere in direct contact with the inside spine 34 of the cover 12, the book block may be opened freely and flexed independently of the spine 20 allowing the back 32 to bend as seen in FIGS. 2–5, while the spine 20 of the cover 12 remains flat. A strong bond is formed between the book block and the cover since the unitary ribbon 26 is attached to the cover 12 and the book block 14 using the full area of the first and second sections 28, 30 for attachment. A thicker, and thus heavier, book block will thus utilize a wider ribbon, and be more firmly attached to the cover due to the greater adhesive area. The opened book 10 will generally lie flat as shown in FIG. 2, and if the pages are pressed downward as shown in FIG. 3, the book block 14 is free to open so the pages are nearly flat without bending the spine 20 of the cover 12.

The tubular ribbon 26 is very flexible and does not increase in stiffness appreciably when glue is applied. The ribbon tube is preferably woven of a plastic material that will work compatibly with different types of glue and thus be able to attach well to both the prepared rough surface of the book block and the normally smooth surface of the cover. The final product is a book that has both a cover spine that is stiff and a book block back that is flexible because of its separation from the cover by the hollow of the woven ribbon tube 26. The back 32 of the book block 14 is flexible because it is attached to the surface of the woven tubular ribbon 26 which is very flexible.

It is desirable to have the cover spine become as stiff as possible because with a stiff spine separated from the book block, the back of the book block will pop up on opening and the appearance of a deep "V" at the binding will be substantially eliminated.

In manufacturing a quantity of books 10 the woven tubular ribbon 26 is fed from a spool. Although the woven ribbon 26 may be somewhat wider than the book block, it is preferred that the ribbon 26 be substantially the same width as the book block.

Preferably, the covers are fed singly into a stream to receive the adhesive and tubular ribbon. Adhesive 36 is first applied to the covers 12. A hot melt adhesive such as Swift's 85602 is extruded along the cover spines and the second longitudinal section 30 of the ribbon 26 is attached to a cover 12. Each cover is separated using a hot knife to cut through the ribbon tube.

The adhesive 38 is extruded onto the book blocks 14 which have been prepared on a conventional binding line, as described above, and the book blocks are then adhesively attached to the woven tubular ribbons 26 which have been attached to the covers 12.

The adhesive 38 is preferably applied only to the backs 32 of the book blocks 14, but if desired the adhesive 38 may be applied to a portion of the first and last leaves of the book giving an added area of attachment of the book block 14 to the cover 12.

In an alternative process, the tubular ribbons may be attached first to the book blocks and then to the covers.

It should be noted that case bound books of this invention may be formed by attaching the tubular ribbon to the stiff board covers of a conventional case binding to simulate the appearance of a hard bound book.

It is further understood that the invention is not confined to the particular construction and arrangement of parts herein illustrated and described, but embraces such modified forms hereof as come within the scope of the following claims.

I claim:

1. A bound book comprising:

(a) a book block with a plurality of sheets joined together at their spine edges, the block having a back;

(b) a cover having an inner spine portion; and (c) a tubular woven ribbon having interwoven warp yarns and filling yarn which present interstices for reception of adhesive, the ribbon being of a circumference substantially twice the width of the book block, wherein the tubular ribbon has first and second longitudinal sections, the first section being attached by a first adhesive to the back of the block and the second section being attached by a second adhesive to the inner spine portion of the cover, the tubular woven ribbon permitting the back of the book block to be spaced from the inner spine portion of the cover and to flex independently thereof when the book is open so that the sheets of the open book will lie relatively flat at the back of the open book.

2. The book of claim 1 wherein the yarns of the tubular woven ribbon are formed of polyester fibers having a melting point of above 300° F.

3. The book of claim 1 wherein the woven ribbon is heat treated to make the ribbon more dimensionally stable.

4. The book of claim 1 wherein there are 25 to 80 picks per inch per side of filling yarn and 133 to 266 warp yarns per inch width of ribbon.

* * * * *